US006515556B1

(12) United States Patent
Kato et al.

(10) Patent No.: US 6,515,556 B1
(45) Date of Patent: Feb. 4, 2003

(54) COUPLING LINE WITH AN UNCOUPLED MIDDLE PORTION

(75) Inventors: Noboru Kato, Sabae (JP); Noriaki Tsukada, Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/708,143

(22) Filed: Nov. 8, 2000

(30) Foreign Application Priority Data

Nov. 10, 1999 (JP) ..... 11-320015

(51) Int. Cl.[7] ..... H01P 5/10; H01P 5/18
(52) U.S. Cl. ..... 333/116; 333/25; 333/26
(58) Field of Search ..... 333/116, 185, 333/25, 26; 336/232

(56) References Cited

U.S. PATENT DOCUMENTS 5,451,914 A * 9/1995 Stengel ..... 333/25
5,818,308 A * 10/1998 Tanaka et al. ..... 333/116

* cited by examiner

*Primary Examiner*—Justin P. Bettendorf
(74) *Attorney, Agent, or Firm*—Keating & Bennett, LLP

(57) ABSTRACT

It is to provide a high-frequency component using a small coupling line, capable of easily adjusting an electrical characteristic. A first transmission line including three line sections constructs a ¼-wavelength strip line. A second transmission line including three line sections also constructs a ¼-wavelength strip line. The line section on one-end side in the first transmission line is faced to the line section on one-end side in the second transmission line, while a dielectric sheet is disposed between both of the line sections, thereby mutually coupling both transmission lines electro-magnetically. The line section on another-end side in the first transmission line is also faced to the line section on another-end side in the second transmission line. While the dielectric sheet is disposed between both of the line sections, thereby mutually coupling both transmission lines electro-magnetically.

19 Claims, 9 Drawing Sheets

COUPLING LINE WITH AN UNCOUPLED MIDDLE PORTION

BACKGROUND OF THE INVENTION

1. Field of the Invention

The present invention relates to a high-frequency component using a coupling line, more particularly, to a high-frequency component using a coupling line, which is used as a coupler (directional coupler) in an IC for radio communication equipment, a phased converter, and a balun (balance/unbalance signal converter).

2. Description of the Related Art

A balun (balance/unbalance converter) is exemplified as a high-frequency component using a coupling line. The balun mutually converts a balance signal of a balance transmission line and an unbalance signal of an unbalance transmission line. Note that the balance transmission line means having two signal lines which become a pair and transmitting a signal (balance signal) as an electrical potential between the two signal lines and, on the contrary, the unbalance signal means transmitting a signal (unbalance signal) as an electrical potential of one signal line with respect to the ground potential (zero potential), for example, a coaxial line or a microstrip line provided on a substrate.

FIG. 15 shows one example of a conventional laminating type balun. A laminating type balun 120 comprises: a dielectric layer 122*c* provided with a lead electrode 121 on the surface thereof; a dielectric layer 122*d* provided with a ½-wavelength strip line 123 having a spiral portion on the surface thereof; a dielectric layer 122*e* provided with ¼-wavelength strip lines 124 and 125 like spiral forms on the surface thereof; dielectric layers 122*a* and 122*y* provided with shielding electrodes 126 and 127 on the surface thereof, respectively; dummy dielectric layers 122*b* and 122*f;* and the like. The strip lines 124 and 125 are electro-magnetically coupled to a right portion 123*a* and a left portion 123*b* of the strip line 123. That is, the strip lines 124 and 125 constructing the balance transmission line are electro-magnetically coupled to the strip line 123 constructing the unbalance transmission line throughout the substantially entire length of the strip lines.

According to the conventional balun 120, the layer thickness of the dielectric layer 122*d* is changed, thereby adjusting the electro-magnetic coupling degree between the strip lines 124 and 125 and the strip line 123. Therefore, the layer thickness of the dielectric layer 122*d* must be made thick when manufacturing a product whose electro-magnetic coupling degree is loose between the strip lines 124 and 125 and the strip line 123 and, thus, the miniaturization is difficult.

If increasing a characteristic impedance of the balun 120, it is necessary to narrow the line widths of the strip lines 123 to 125 and narrow the line interval of the spiral portion. Thus, a printing technique at a high level is required to form the strip lines 123 to 125. Further, when narrowing the line widths of the strip lines 123 to 125, resistivities of the strip lines 123 to 125 rise and a problem to increase the insertion loss also arises.

Then, it is an object of the present invention to provide a high-frequency component using a coupling line with a small size, capable of easily adjusting an electrical characteristic.

SUMMARY OF THE INVENTION

In order to attain the object, according to the present invention, there is provided a high-frequency component using a coupling line which has a first transmission line and a second transmission line, at least one coupling portion for mutually coupling the first transmission line and the second transmission line electro-magnetically, and at least three line sections to which the first transmission line and second transmission line in the coupling portion are serially connected electrically, wherein line sections on one end sides of the first transmission line and the second transmission line in the coupling portion are mutually coupled electro magnetically, and the line sections on another-end sides of the first transmission line and the second transmission line are mutually coupled electro-magnetically. As the high-frequency component using the coupling line, a coupler or balun, etc. is exemplified.

According to the above-discussed construction, even in a central portion in the first transmission line in the coupling portion is not faced to a central portion in the second transmission line in the coupling portion, both end portions of the first and second transmission lines are coupled electro-magnetically. This causes a phase of a signal transmitted through the second transmission line to be shifted by a desired amount of phase difference with respect to a phase of a signal transmitted through the first transmission line.

Further, as compared with a case of electro-magnetically coupling the first transmission line and the second transmission line by the entire lines thereof, the electro-magnetic coupling degree between the first and second transmission lines is decreased. Therefore, when designing a loose electro-magnetic coupling, it is unnecessary to increase a distance between the first and second transmission lines in the coupling portion. In case of a high-frequency component with a laminating structure, it is able to reduce a thickness of the dielectric layer between the conductive patterns, which are mutually coupled electro-magnetically, and to reduce the height of the high frequency component.

By connecting a capacitor for impedance adjustment to an input terminal or output terminal of the first transmission line or second transmission line, it is possible to match desired input/output impedances corresponding to an impedance of an external circuit.

DESCRIPTION OF THE PREFERRED EMBODIMENTS

The description turns to embodiments of a high-frequency component using a coupling line according to the present invention with reference to the accompanying drawings hereinbelow.

Figure 1:
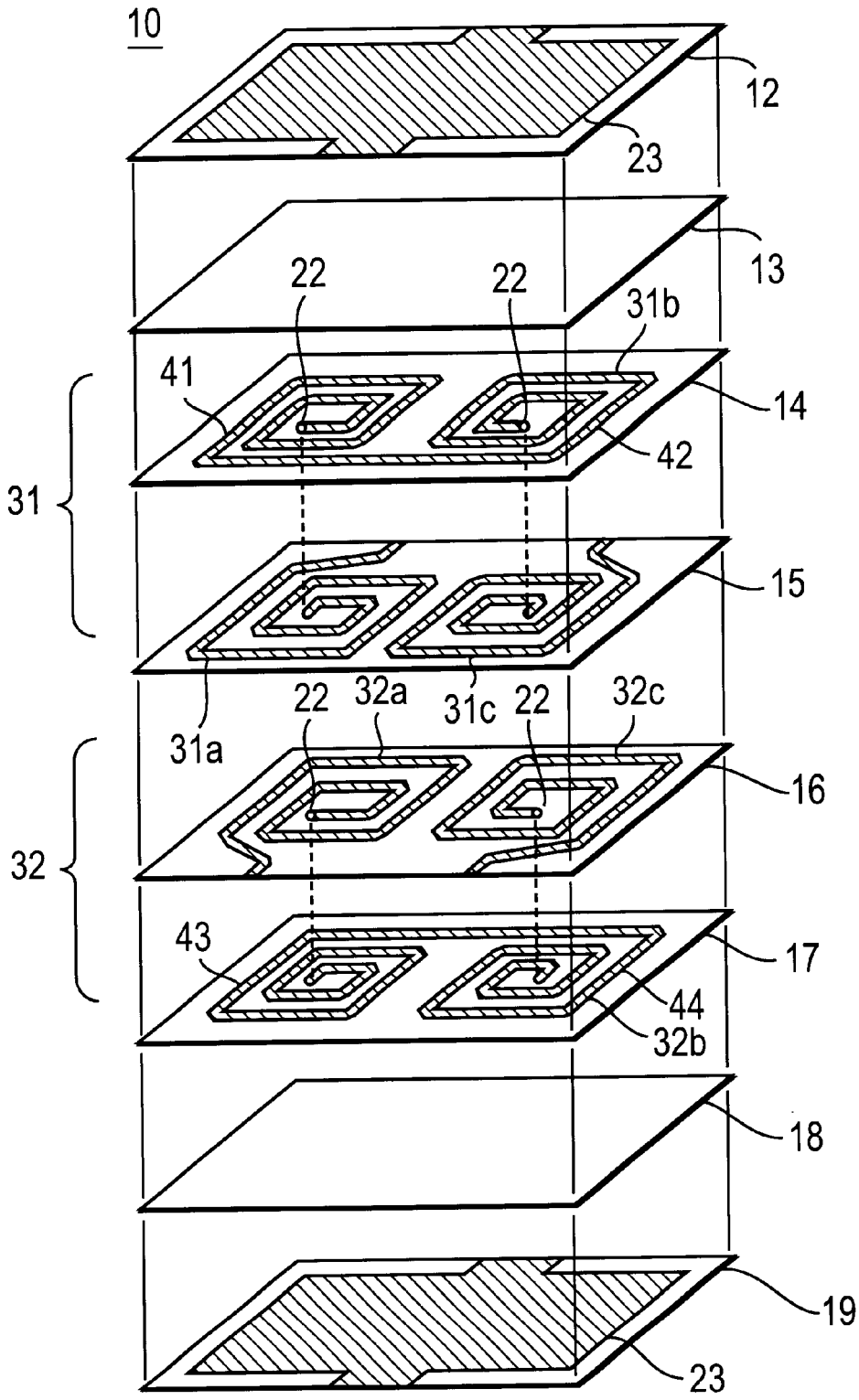
FIG. 1 is an exploded perspective view showing a construction of a first embodiment of a high-frequency component using a coupling line according to the present invention.
Figure 2:
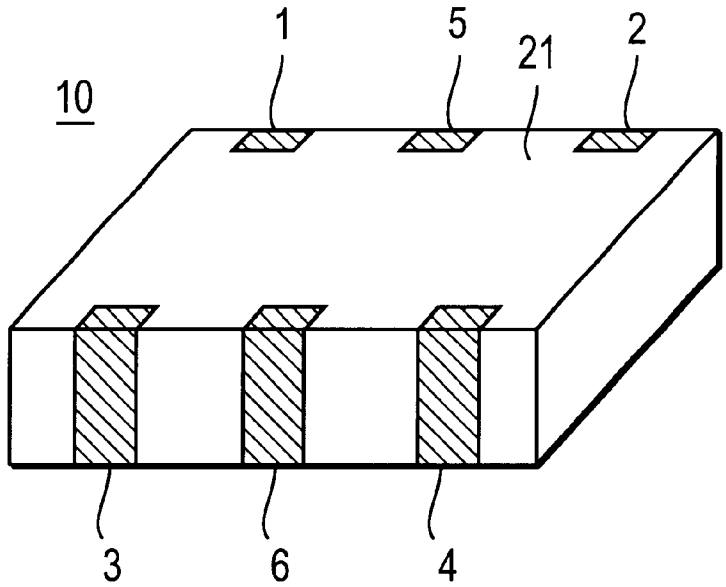
FIG. 2 is a perspective view showing an appearance of the high-frequency component in FIG. 1.
Figure 3:
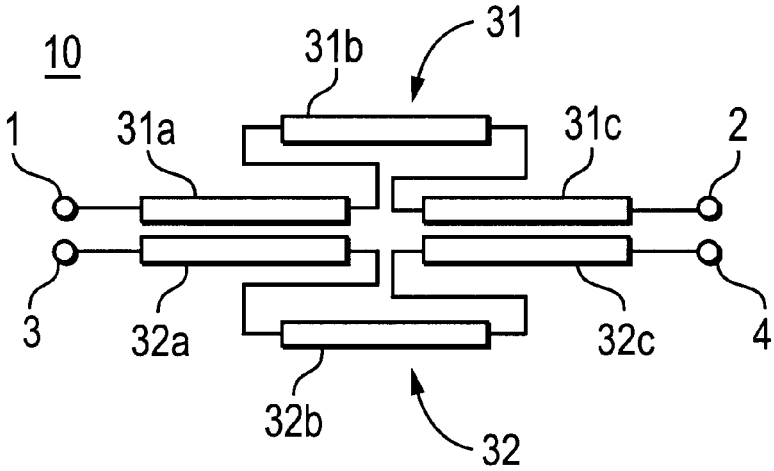
FIG. 3 is an equivalent circuit diagram of the high-frequency component in FIG. 2.

[First embodiment: FIGS. 1 to 3]

FIGS. 1 to 3 show one embodiment to apply a high-frequency component using a coupling line according to the present invention to a coupler. As shown in FIG. 1, a coupler 10 comprises: dielectric sheets 15 and 14 provided with line sections 31*a* and 31*c* and a line section 31*b* constructing a first transmission line (main line) 31 onto surfaces of the dielectric sheets 15 and 14, respectively; dielectric sheets 16 and 17 provided with line sections 32*a* and 32*c* and a line section 32*b* constructing a second transmission line (subline) 32 onto surfaces of the dielectric sheets 16 and 17, respectively; dielectric sheets 12 and 19 provided with shielding electrodes 23 onto the dielectric sheets 12 and 19, respectively; dielectric sheets 13 and 18 for dummy; and the like.

As the dielectric sheets 12 to 19, resin such as epoxy, or ceramic dielectric, etc. is used. The line sections 31*a* to 31*c* and 32*a* to 32*c* and the shield electrodes 23 are formed by a method such as a sputtering method, deposition method, or printing method, and made up of materials such as Ag-Pd, Ag, Pd, and Cu.

The line section 31*a* is spiral with a structure winding in the counter clockwise direction, and is formed in an almost-half area on the left of the sheet 15. One end portion of the line section 31*a* is exposed to the left of a side on the back of the sheet 15, and another end portion thereof is disposed at the center on the left of the sheet 15. The line section 31*c* is spiral, and is formed in an almost half area on the right of the sheet 15. One end portion of the line section 31*c* is exposed to the right of a side on the back of the sheet 15, and another end portion thereof is disposed at the center on the right of the sheet 15.

The line section 31*b* has two spiral portions 41 and 42, and the spiral portions 41 and 42 are formed on the left and right of the sheet 14, respectively. One end portion of the line section 31*b* is positioned at the center on the left of the sheet 14 and another end portion thereof is positioned at the center on the right of the sheet 14. Although this example shows that the spiral portions 41 and 42 in the line section 31*b* are overlapped with the shapes and configurations of the line section 31*a* and 31*c*, the configurations and overlapping portions are determined arbitrarily (a case of the line section 32*b* is also similar, which will be explained later on). The three line sections 31*a*, 31*b*, and 31*c* are electrically connected in series by way of via holes 22, which are formed in the sheet 14, thereby constructing the first transmission line (main line) 31. The main line 31 is a strip line with a double-layer structure, having a substantially ¼ wavelength of a desired central frequency.

Likewise, the line section 32*a* is spiral with a structure winding in the clockwise direction, and is formed in an almost-half area on the left of the sheet 15. One end portion of the line section 32*a* is exposed to the left of a side on the front of the sheet 16, and another end portion thereof is disposed at the center on the left of the sheet 16. The line section 32*c* is spiral, and is formed in an almost-half area on the right of the sheet 16. One end portion of the line section 32*c* is exposed to the right of a side of the front of the sheet 16, and another end portion thereof is disposed at the center on the right of the sheet 16.

The line section 32*b* has two spiral portions 43 and 44, and the spiral portions 43 and 44 are formed on the left and right of the sheet 17, respectively. One end portion of the line section 32*b* is positioned at the center portion on the sheet 17 and another end portion thereof is positioned at the center on the right of the sheet 17. The three line sections 32*a*, 32*b*, and 32*c* are electrically connected in series by way of the via holes 22, which are formed in the sheet 16, thereby constructing the second transmission line (subline) 32. The subline 32 is a strip line with a double-layer structure, having a substantially ¼ wavelength of a desired central frequency.

Both and portions of the main line 31 are opposed to both end portions of the subline 32, while the sheet 15 is disposed between the main line 31 and subline 32. To be more specific, the line section 31*a* of the main line 31 is opposed to the line section 32*a* of the subline 32, and both those lines are mutually coupled electro-magnetically. Further, the line section 31*c* of the main line 31 is opposed to the line section 32*c* of the subline 32, and both those lines are mutually coupled electro-magnetically. Incidentally, it is not always necessary to completely overlap the line sections 31*a* and 31*c* to the line sections 32*a* and 32*c* in the dielectric sheet laminating direction, and the coupling amount between the main line 31 and subline 32 may be changed by mutually displacing the lead positions and by mutually displacing the conductive patterns.

The shielding electrodes 23 are provided on the substantially entire surfaces of the sheets 12 and 19. One end portions of the shielding electrodes 23 are exposed to the center of sides on the front of the sheets 12 and 19. Another end portions of the shielding electrodes 23 are exposed to the center of sides on the back of the sheets 12 and 19. The shielding electrodes 23 are disposed so as to sandwich the main line 31 and subline 32. Preferably, the shielding electrodes 23 are disposed at positions apart from the lines 31 and 32 by predetermined distances in consideration of a characteristic of the coupler 10.

The sheets 12 to 19 are laminated and further a protection sheet (not shown) is arranged thereon. After that, the sheets 12 to 19 and the protection sheet are baked integrally, thereby forming a laminating body 21 as shown in FIG. 2. Input/output terminal electrodes 1 and 2 of the main line 31 and a ground terminal electrode 5 are formed on a side surface on the back of the laminating body 21. Input/output terminal electrodes 3 and 4 of the subline 32 and a ground terminal electrode 6 are formed on a side surface on the front of the laminating body 21. The terminal electrodes 1 to 6 are formed by a method such as a sputtering method, deposition method, or printing method, and made up of the materials such as Ag-Pd, Ag, Pd, and Cu.

The input/output terminal electrode 1 is electrically connected to one end portion of the main line 31 (specifically, the end portion of the line section 31*a*). The input/output terminal electrode 2 is electrically connected to another end portion of the main line 31 (specifically, the end portion of the line section 31*c*). The input/output terminal electrode 3 is electrically connected to one end portion of the subline 32 (specifically, the end portion of the line section 32*c*). The input/output terminal electrode 4 is electrically connected to another end portion of the subline 32 (specifically, the end portion of the line section 32*c*). The ground terminal electrodes 5 and 6 are electrically connected to the shielding electrodes 23, respectively. FIG. 3 is an electrical equivalent circuit diagram of the coupler 10.

According to the coupler 10 with the above-stated construction, if an intermediate portion of the main line 31 (specifically, line section 31*b*) is not faced to an intermediate portion of the subline 32 (line section 32*b*), both end portions of the main line 31 are faced to both end portions of the subline 32, thereby electro-magnetically coupling the main line 31 to the subline 32. Thus, a phase of a signal transmitted through the subline 32 is rotated by 90° with respect to a phase of a signal transmitted through the main line 31 (because the lines 31 and 32 are ¼-wavelength strip lines). The phase shift of 90° causes directional property for the signal transmission. Then, if the main line is electrically coupled to the subline only by any one of input sides and output sides, a signal phase is not rotated by 90° between the main line and subline and the coupler 10 does not function as a coupler. Therefore, it is necessary to electro-magnetically couple the main line to the subline by both of the input sides and output sides.

A length between the line sections 31*a* and 32*a* or the line sections 31*c* and 32*c* is changed and, thus, it is able to control an electro-magnetic coupling degree between the main line 31 and subline 32. In this case, preferably, the coupler is designed so as to make the length between the line sections 31*a* and 32*a* equal to the length between the line sections 31*c* and 32*c* in view of a balance of an electric characteristic between the input side and the output side in the coupler 10.

Since electro-magnetically coupling the main line 31 to the subline 32 only by both end portions, the electro-magnetic coupling degree between the main line 31 and the subline 32 is made smaller, as compared a case of electro-magnetically coupling therebetween by the whole line according to a conventional device. Therefore, when designing a coupler whose electro-magnetic coupling is loose, it is unnecessary to increase a distance between the main line 31 and the subline 32 (in other words, a thickness of the dielectric sheet 15), so that it is also capable of lowering the height of the coupler 10.

By narrowing line widths or line intervals of the line sections 31*a* to 32*c* constructing the main line 31 and subline 32, an external size of the coupler 10 may be further made smaller.

Figure 4:
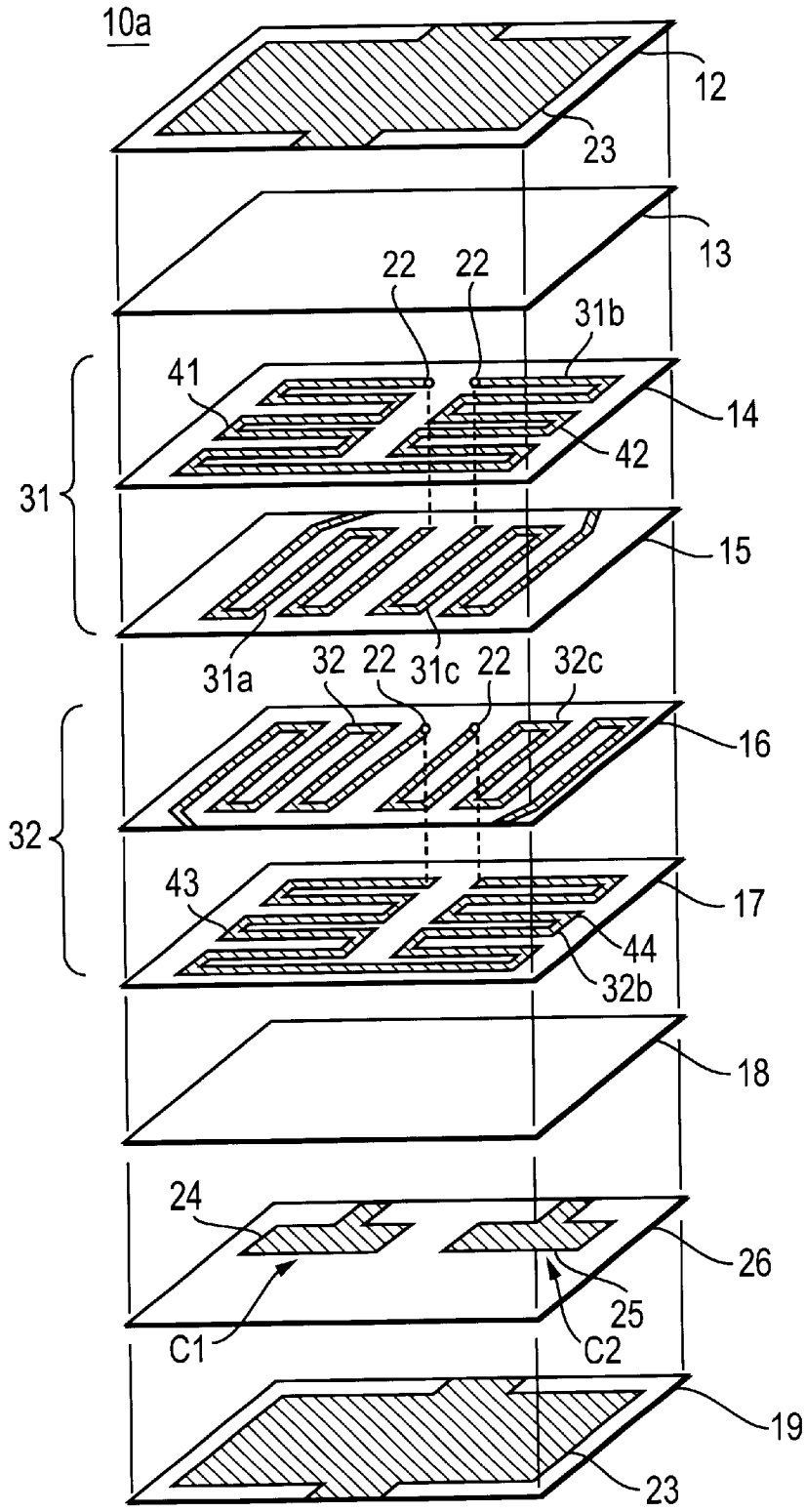
FIG. 4 is an exploded perspective view showing a construction of a second embodiment of the high-frequency component using the coupling line according to the present invention.
Figure 5:
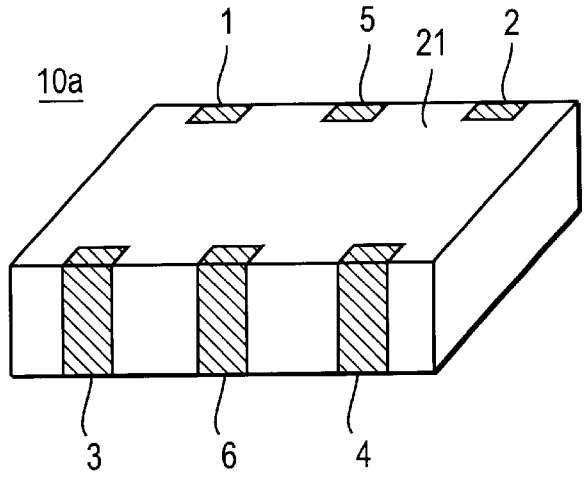
FIG. 5 is a perspective view showing an appearance of the high-frequency component in FIG. 4.
Figure 6:
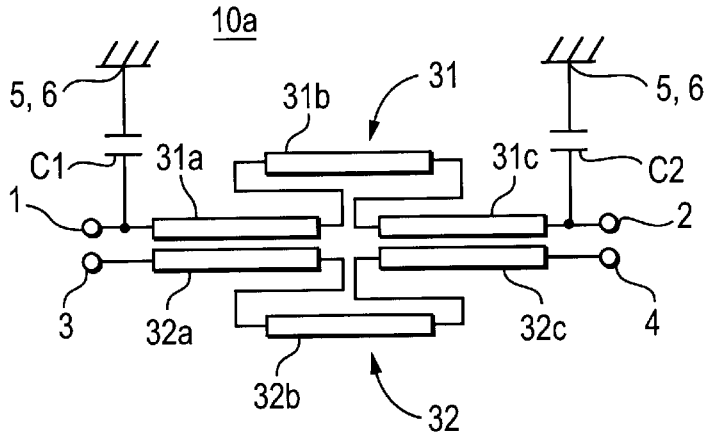
FIG. 6 is an equivalent circuit diagram of the high-frequency component in FIG. 5.

[Second embodiment: FIGS. 4 to 6]

FIGS. 4 to 6 show another embodiment to apply the high-frequency component using the coupling line according to the present invention to the coupler. A coupler 10*a* is a coupler obtained by modifying the pattern forms of the three line sections 31*a* to 31*c* constructing the first transmission line (main line) 31 in the coupler 10 of the first embodiment described in FIGS. 1 to 3 to pattern forms which meander, and also by modifying the pattern forms of the three line sections 32*a* to 32*c* constructing the second transmission line (sub line) 32 in the coupler 10 of the first embodiment described in FIGS. 1 to 3 to pattern forms which meander. Note that referring to FIGS. 4 to 6, portions corresponding to those in FIGS. 1 to 3 are labeled to corresponding reference numerals and indicated, and the overlapped description is omitted.

According to the present second embodiment, it is also possible to control the electro-magnetic coupling amount, similarly to the first embodiment. If designing the coupler whose electro-magnetic coupling is loose, it is unnecessary to increase a distance between the main line 31 and the subline 32 (a thickness of the dielectric layer 15) in the laminating body 21 and the height of laminating body 21 can be lowered.

Moreover, according to the coupler 10*a,* disposed between dielectric sheets 18 and 19 is a dielectric sheet 26 provided with capacitor electrodes 24 and 25 thereon. The capacitor electrodes 24 and 25 are faced to the shielding electrode 23. While the dielectric sheet 26 is disposed between the capacitor electrodes 24 and 25 and the shielding electrode 23, and electrically connected to the terminal electrodes 1 and 2. Consequently, connected between the terminal electrode 1 and the ground terminal electrodes 5 and 6 is an electrostatic capacitance C1 which is formed between the capacitor electrode 2 and the shielding electrode 23. Also connected between the terminal electrode 2 and the ground terminal electrodes 5 and 6 is an electrostatic capacitance C2 which is formed between the capacitor electrode 25 and the shielding electrode 23. The electrostatic capacitances C1 and C2 construct what is called a low-pass filter circuit together with an inductance of the main line 31, and adds a low-pass filter function to the main line 31. The electrostatic capacitances C1 and C2 function as capacitors for input/output impedance adjustment of the coupler 10*a*. Values of the electrostatic capacitances C1 and C2 are adjusted, so that it is possible to set the input/output impedances of the coupler 10*a* to be equal to values which match with impedances of an external circuit. Further, as the necessity may arise, it is sufficient to form a capacitor electrode for coupling, which electrostatically couples the capacitor electrodes 24 and 25, onto the surface of the dielectric sheet 18. As a result, the main line 31 constructs a so-called simultaneous Chebyshev type circuit, thereby making it possible to form a pole to a filter characteristic of the main line 31, to which the low-pass filter function is added.

Figure 7:
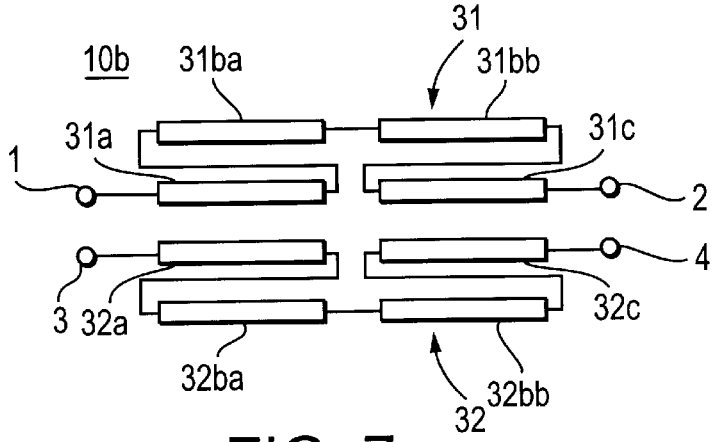
FIG. 7 is an equivalent circuit diagram of a third embodiment of the high-frequency component using the coupling line according to the present invention.
Figure 8:
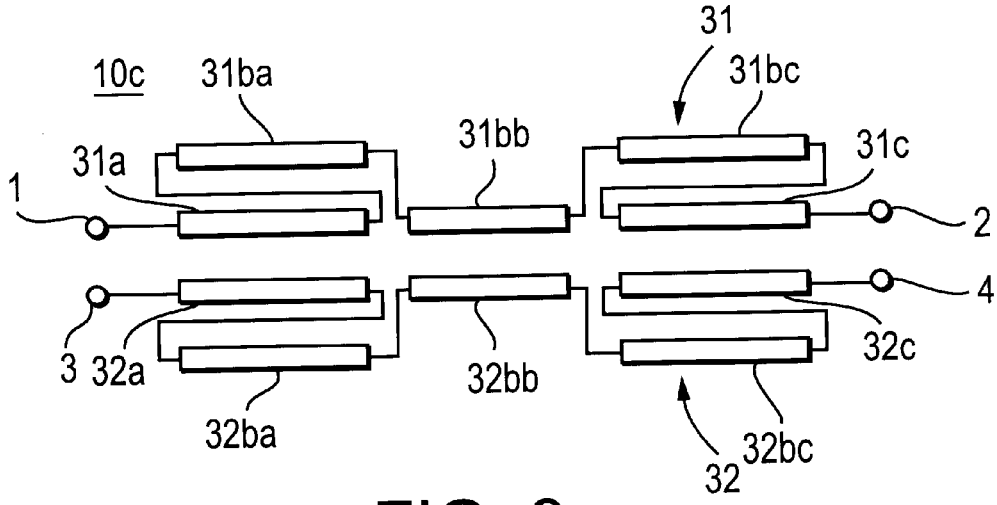
FIG. 8 is an equivalent circuit diagram of a fourth embodiment of the high-frequency component using the coupling line according to the present invention.
Figure 9:
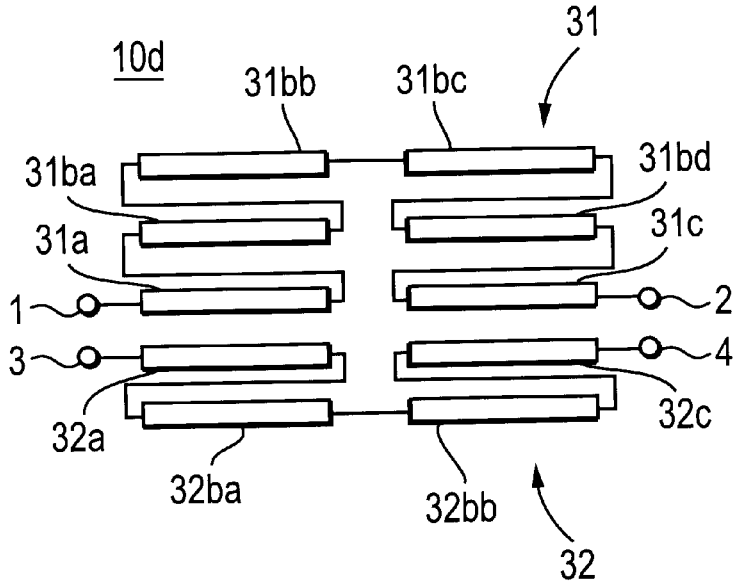
FIG. 9 is an equivalent circuit diagram of a fifth embodiment of the high-frequency component using the coupling line according to the present invention.

[Third to fifth embodiments: FIGS. 7 to 9]

Although according to the coupler 10 and coupler 10*e* in the aforementioned first and second embodiments, the first transmission line 31 and second transmission line 32 comprise the three line sections, respectively, the first transmission line 31 and second transmission line 32 may comprise four or more line sections in accordance with necessary coupling degrees. FIG. 7 shows, as an exemplification, a coupler 10*b* according to a third embodiment wherein two line sections 31*ba* and 31*bb* are serially connected between the line section 31*a* on one end side of the first transmission line 31 and the line section 31*c* on another end side thereof, and two line sections 32*ba* and 32*bb* are serially connected between the line section 32*a* on one end side of the second transmission line 32 and the line section 32*c* on another end side thereof. The line sections 31*ba* to 32*bb* have pattern forms which are spiral or meandering.

According to a coupler 10*c* in a fourth embodiment as shown in FIG. 8, three line sections 31*ba* to 31*bc* are serially connected between the line section 31*a* on one end side of the first transmission line 31 and the line section 31*c* on another end side thereof, and three line sections 32*ba* and 32*bc* are connected between the line section 32*a* on one end side of the second transmission line 32 and the line section 32*c* on another end side thereof. The line sections 31*bb* and 32*bb* are electro-magnetically coupled.

Further, according to a coupler 10*d* in a fifth embodiment as shown in FIG. 9, four line sections 31*ba* to 31*bd* are serially connected between the line section 31*a* on one end side of the first transmission line 31 and the line section 31*c* on another end side thereof. Two line sections 32*ba* and 32*bb* are connected between the line section 32*a* on one end side of the second transmission line 32 and the line section 32*c* on another end side thereof. By sequentially laminating and integrally baking a dielectric sheet on which the line sections 31*bb* and 31*bc* are formed, a dielectric sheet on which the line sections 31*ba* and 31*bd* are formed, a dielectric sheet on which the line sections 31*a* and 31*c* are formed, a dielectric sheet on which the line sections 32*a* and 32*c* are formed, and a dielectric sheet on which the line sections 32*ba* and 32*bb* are formed, etc., the coupler 10*d* is manufactured as a laminating type coupler.

Figure 10:
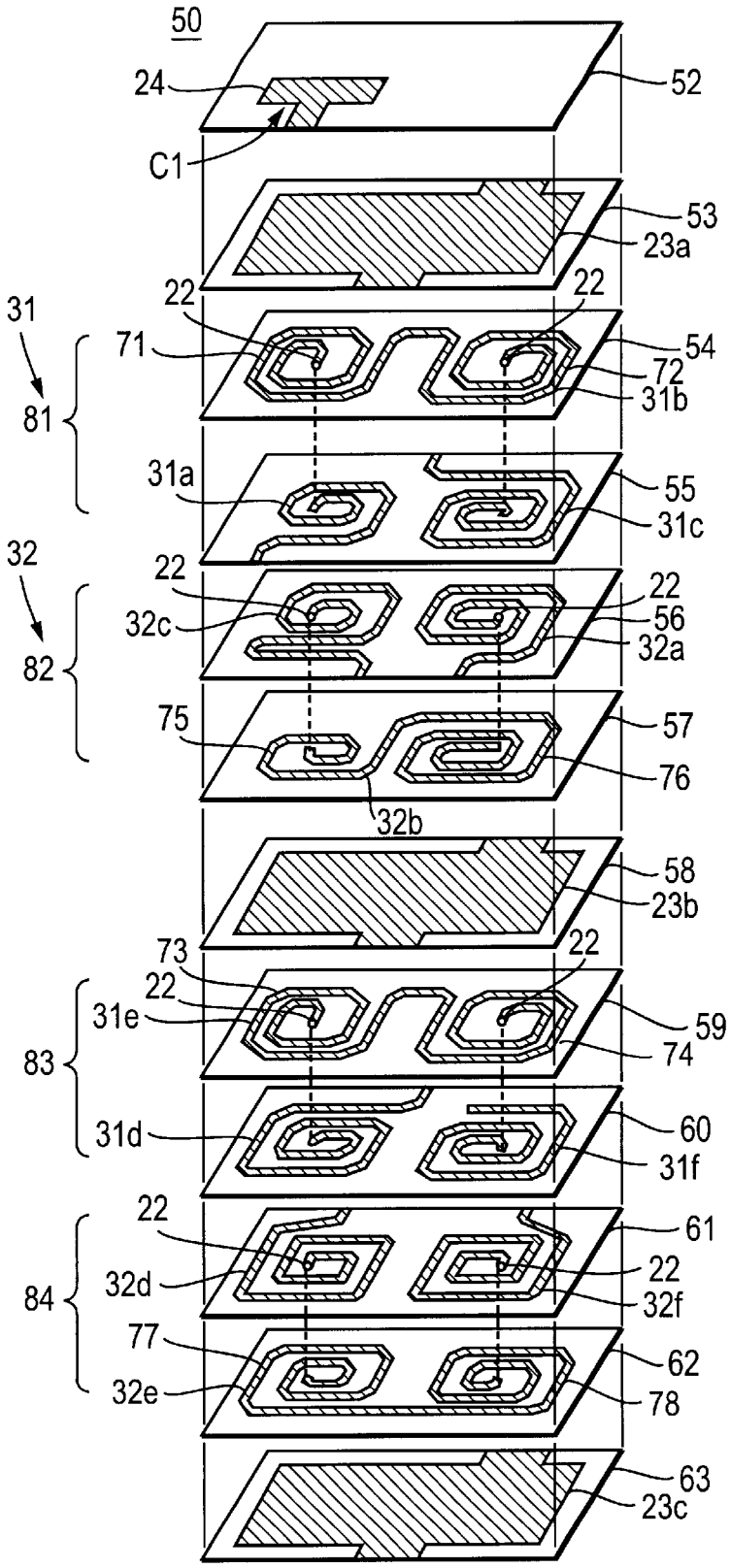
FIG. 10 is an exploded perspective view showing a construction of a sixth embodiment of the high-frequency component using the coupling line according to the present invention.
Figure 11:
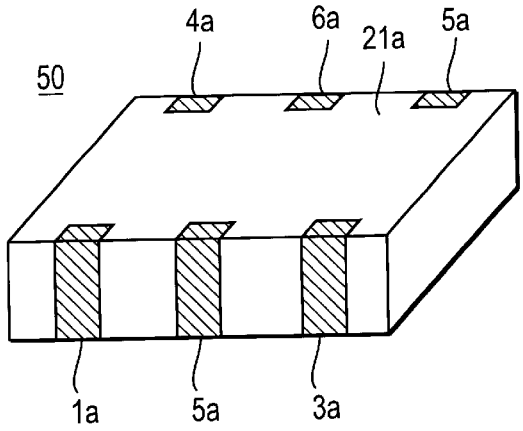
FIG. 11 is a perspective view showing an appearance of the high-frequency component in FIG. 10.
Figure 12:
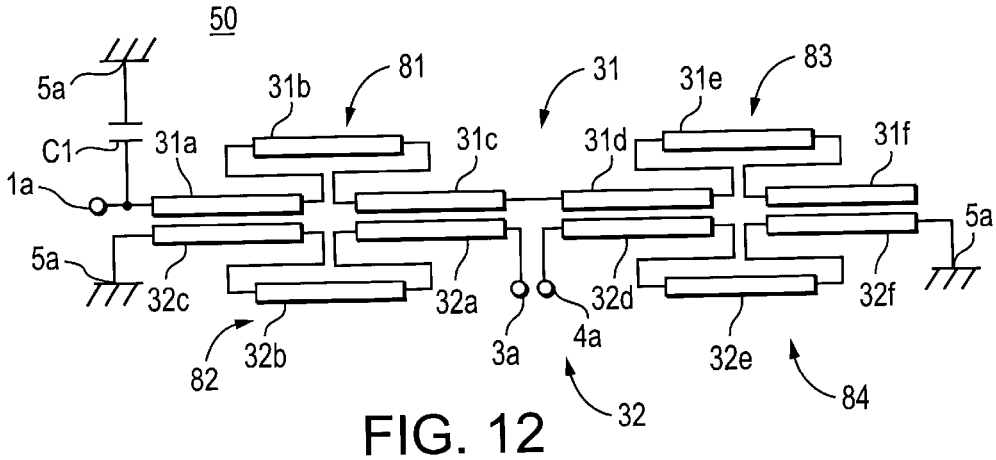
FIG. 12 is an equivalent circuit diagram of the high-frequency component in FIG. 11.

[Sixth embodiment: FIGS. 10 to 12]

FIGS. 10 to 12 show an embodiment to apply the high-frequency component using the coupling line according to the present invention to a balun. As shown in FIG. 10, a balun 50 comprises: dielectric sheets 55, 54, 59, and 60 provided with the line sections 31*a* and 31*c*, the line section 31*b*, a line section 31*e*, and line sections 31*d* and 31*f* onto surfaces of the dielectric sheets 55, 54, 59, and 60 which construct the first transmission line (unbalance line) 31; dielectric sheets 56, 57, 61, and 62 provided with the line sections 32*a* and 32*c*, the line section 32*b*, line sections 32*d* and 32*f*, and a line section 32*e* onto surfaces of the dielectric sheets 56, 57, 61, and 62 which construct the second transmission line (balance line) 32; dielectric sheets 53, 58, and 63 provided with shielding electrodes 23*a*, 23*b*, and 23*c* onto surfaces of the dielectric sheets 53, 58, and 63; and a dielectric sheet 52 provided with a capacitor electrode 24, etc.

The line section 31*a* is spiral, and one end portion thereof is exposed to the left of a side on the front of the sheet 55 and another end portion thereof is positioned at the center on the left of the sheet 55. The line section 31*c* is spiral, and one end portion thereof is exposed to the center of a side on the back of the sheet 55 and another end portion thereof is positioned at the center on the right of the sheet 55.

The line section 31*b* has two spiral portions 71 and 72 which are formed on the left and right of the sheet 54. One end portion of the line section 31*b* is positioned at the center on the left of the sheet 54 and another end portion thereof is positioned at the center on the right of the sheet 54. The three line sections 31*a* to 31*c* are serially connected electrically through the via holes 32 which are formed to the sheet 54, and form a strip line 81 with a double structure, which has a substantially ¼ wavelength of a desired central frequency.

The line section 32*a* is spiral, and one end portion thereof is exposed to the right of a side on the front of the sheet 56 and another end portion thereof is positioned at the center on the right of the sheet 56. The line section 32*c* is spiral, and one end portion thereof is exposed to the center of a side on the front of the sheet 56 and another end portion thereof is positioned at the center on the left of the sheet 56.

The line section 32*b* has two spiral portions 75 and 76 which are formed on the left and right of the sheet 57. The three line sections 32*a* to 32*c* are serially connected electrically through the via holes 22 which are formed to the sheet 56, and form a strip line 82 with a double-layer structure, which has a substantially ¼ wavelength of a desired central frequency.

Both end portions of the strip line 81 are faced to both end portions of the strip line 82, while the sheet 55 is disposed therebetween. To be more specific, the line section 31*a* of the strip line 81 is faced to the line section 32*c* of the strip line 82, thereby mutually coupling the strip line 81 to the strip line 82 electro-magnetically. Further, the line section 31*c* of the strip line 81 is faced to the line section 32*a* of the strip line 82, thereby mutually coupling the strip line 81 to the strip line 82 electro-magnetically.

Likewise, the line section 31*d* is spiral, and one end portion thereof is exposed to the center of a side on the back of the sheet 60 and another end portion thereof is positioned at the center on the left of the sheet 60. The line section 31*f* is spiral, and one end portion thereof is exposed to the center on the right of the sheet 60 and another end portion thereof is positioned on the back of the sheet 60.

The line section 31*e* has two spiral portions 73 and 74 which are formed on the left and right of the sheet 59. One end portion of the line section 31*e* is positioned at the center on the left of the sheet 59 and another end portion is positioned at the center on the right of the sheet 59. The three line sections 31*d* to 31*f* are serially connected electrically through the via holes 22 which are formed to the sheet 59 and form a strip line 83 with a double-layer structure, which has a wavelength of substantial ¼ of a desired central frequency. The strip line 83 is electrically connected in series to the strip line 81 via a relay terminal electrode 6*a* (as will be explained hereinafter), thereby constructing the unbalance line 31.

The line section 32*d* is spiral, and one end portion thereof is exposed to the left of a side on the back of the sheet 61 and another end portion thereof is positioned at the center on the left of the sheet 61. The line section 32*f* is spiral, and one end portion thereof is exposed to the right of a side on the back of the sheet 61 and another end portion of the line section 32*f* is positioned at the center on the right of the sheet 61.

The line section 32*e* has two spiral portions 77 and 78 which are formed on the left and right of the sheet 62. The three line sections 32*d* to 32*f* are serially connected electrically through the via holes 22 which are formed to the sheet 61 and form a strip line 84 with a double structure, which has a wavelength of substantial ¼ of a desired central frequency. The strip line 84 together with the strip line 82 constructs the balance line 32.

Both end portions of the strip line 83 are faced to both end portions of the strip line 84, while the sheet 60 is disposed therebetween. Specifically, the line section 31*d* of the strip line 83 is faced to the line section 32*d* of the strip line 84, thereby mutually coupling the strip line 83 to the strip line 84 electro-magnetically. Further, the line section 31*f* of the strip line 83 is faced to the line section 32*f* of the strip line 84, thereby mutually coupling the strip line 83 to the strip line 84 electro-magnetically.

The shielding electrodes 23*a*, 23*b*, and 23*c* are formed on the substantially entire surfaces of the sheets 53, 58, and 63, and one-end potions of the shielding electrodes 23*a*, 23*b*, and 23*c* are exposed to the center of a side on the front of the sheets 53, 58, and 63 and another-end portions of the shielding electrodes 23*a*, 23*b*, and 23*c* are exposed to the right of a side on the back of the sheets 53, 58, and 63. The strip lines 81 and 82 are disposed between the shielding electrodes 23*a* and 23*b*. The strip lines 83 and 84 are disposed between the shielding electrodes 23*b* and 23*c*.

The capacitor electrode 24 is faced to the shielding electrode 23*a*, while the dielectric sheet 52 is disposed between the capacitor electrode 24 and the shielding electrode 23*a*, thereby forming the electrostatic capacitance C1. The electrostatic capacitance C1 functions as a capacitor for input impedance adjustment of the balun 50.

The sheets 52 to 63 are laminated, and further a protection sheet (not shown) is arranged thereon. After that, those sheets are integrally baked, thereby forming a laminating body 21*a* as shown in FIG. 11. Formed on a side surface on the front of the laminating body 21*a* are an input/output terminal electrode 1*a* of the unbalance line 31, one input/output terminal electrode 3*a* of the balance line 32, and a ground terminal electrode 5*a*. Formed on a side surface on the back of the laminating body 21*a* are another input/output terminal electrode 4*a*, a relay terminal electrode 6*a*, and a ground terminal electrode 5*a*.

One end portion of the unbalance line 31 (the end portion of the line section 31*a*) and the capacitor electrode 24 are electrically connected to the input/output terminal electrode 1*a*. One end portion of the balance line 32 (end portions of the line sections 32*a* and 32*d*) are electrically connected to the input/output terminal electrodes 3*a* and 4*a*. The shielding electrodes 23*a* to 23*c* and another end portion of the balance line 32 (end portions of the line sections 32*c* and 32*f*) are electrically connected to the ground terminal electrodes 5*a*. End portions of the line sections 31*c* and 31*d* constructing the unbalance line 31 are electrically connected to the relay terminal electrode 6*a*. FIG. 12 is an electrical equivalent circuit diagram of the balun 50.

According to the balun 50 with the above-mentioned construction, an unbalance signal transmitted via an external unbalance line is transmitted via the input/output terminal electrode 1*a* to the strip line 81, relay terminal electrode 6*a*, and strip line 83, which construct the unbalance line 31. The strip line 81 is electro-magnetically coupled to the strip line 82, and the strip line 83 is electro-magnetically coupled to the strip line 84. Thus, the unbalance signal is converted into a balance signal, and the balance signal is transmitted to a pair of the strip lines 82 and 84 constructing the balance line 32 and passes through the input/output terminal electrodes 3*a* and 4*a* and is extracted between two signal lines of an external balance line. The balance signal between the two signal lines of the external balance line is inputted to the balun 50 by way of the input/output terminal electrodes 3*a* and 4*a*. By executing an operation opposite to the foregoing operation, the balance signal is converted into the unbalance signal. The unbalance signal passes through the input/output terminal electrode 1*a* and is extracted to the external unbalance line.

Herein, if intermediate portions of the strip lines 81 and 83 of the unbalance line 31 (line sections 31*b* and 31*e*) are not faced to intermediate portions of the strip lines 82 and 84 of the balance line 32 (line sections 32*b* and 32*c*), both end portions of the strip line 81 are faced and electro-magnetically coupled to both end portions of the strip line 82, and both end portions of the strip line 83 are faced and electro-magnetically coupled to both and portions of the strip line 84. Thus, a phase of the balance signal transmitted through the balance line 32 is rotated by 180° from the unbalance signal transmitted through the unbalance line 31 (because the strip lines 81 to 84 have ¼-wavelengths) and it is able to assure a phase difference necessary as the balun.

It is able to control an electro-magnetic coupling quantity between the unbalance line 31 and the balance line 31 by changing a length between the line sections 31*a* and 32*c*, a length between the line sections 31*c* and 31*a*, a length between the line sections 31*d* and 32*d*, or a length between the line sections 31*f* and 32*f*.

Further, the strip lines 81 and 82 are electro-magnetically coupled only by both end portions thereof, and the strip lines 83 and 84 are electro-magnetically coupled only by both end portions thereof. Therefore, as compared with a case of electro-magnetic coupling by the entire lines according to a conventional device, a smaller electro-magnetic coupling quantity is obtained between the unbalance line 31 and the balance line 32. If designing a balun whose electro-magnetic coupling is loose, it is also unnecessary to increase a distance between the unbalance line 31 and the balance line 32 (in other words, a thickness between the dielectric sheets 55 and 60) and, thus, a height of the balun 50 can be reduced.

Moreover, an inductance L between the lines 31 and 32 is increased, since the unbalance line 31 and balance line 32 comprise the strip lines 81 to 84 of the double-layer structure which have spiral forms, respectively. The lines 31 and 32 also form the electrostatic capacitance C among the shielding electrodes 23*a* to 23*c*, and have a predetermined characteristic impedance Z ($=(L/C)^{1/2}$). Therefore, the characteristic impedance Z of the balun 50 can be increased without narrowing the line widths of the strip lines 81 to 84 and the line intervals of the spiral portions. When the characteristic impedance Z is constant, it is capable of increasing the electrostatic capacitance C formed among the shielding electrodes 23*a* to 23*c* and reducing distances between the lines 31 and 32 and the shielding electrodes 23*a* to 23*c* (namely, thicknesses of the dielectric sheets 53, 57, 58, and 62) in accordance with the increase in inductance L of the lines 31 and 32. Accordingly, the height of the balun 50 further can be decreased.

Figure 13:
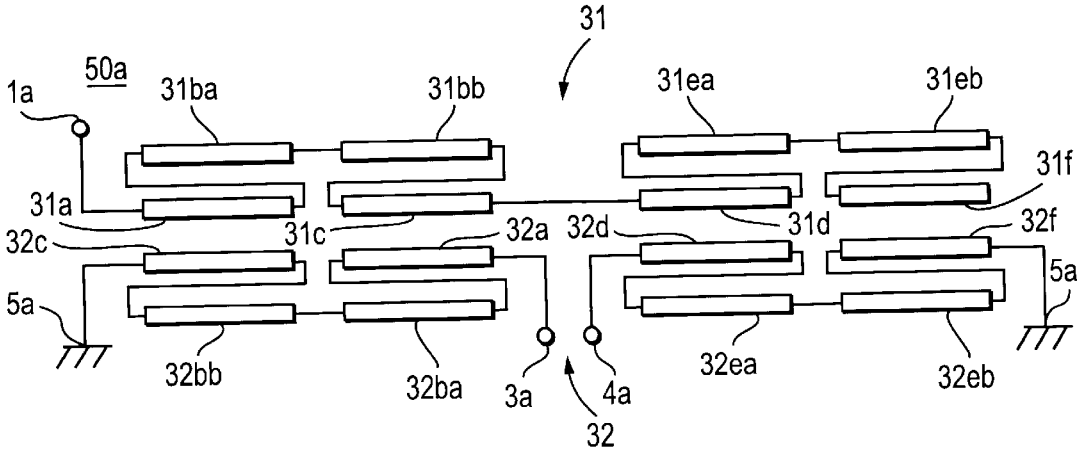
FIG. 13 is an equivalent circuit diagram of a seventh embodiment of the high-frequency component using the coupling line according to the present invention.
Figure 14:
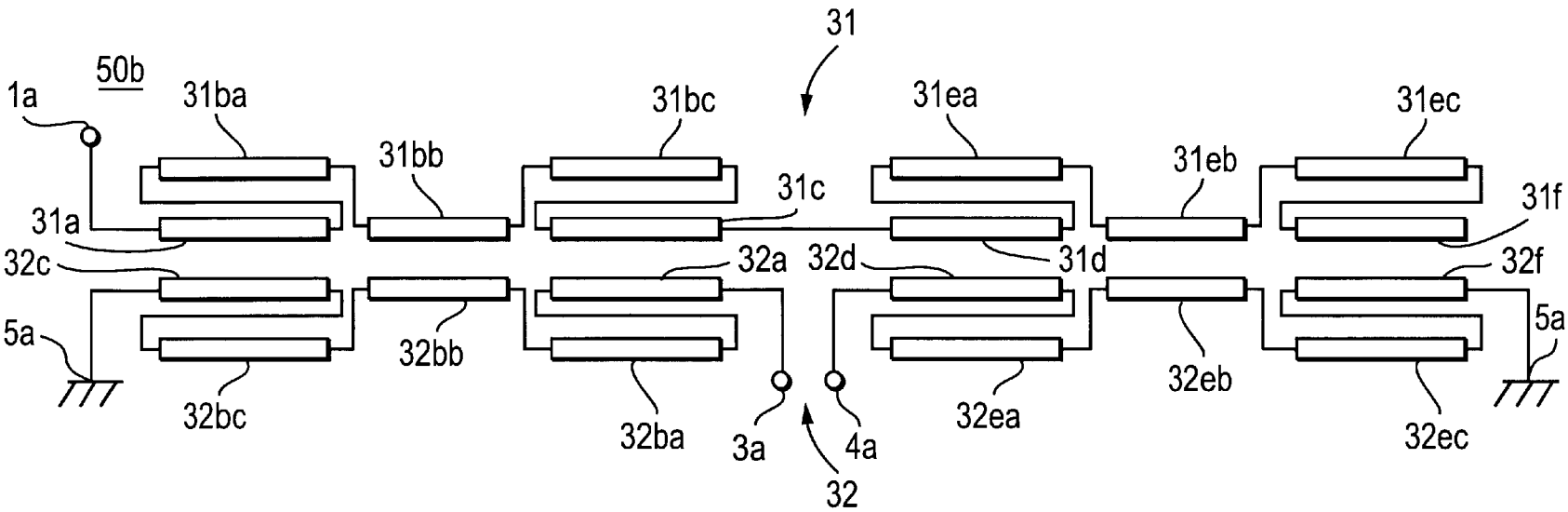
FIG. 14 is an equivalent circuit diagram of an eighth embodiment of the high-frequency component using the coupling line according to the present invention.
Figure 15:
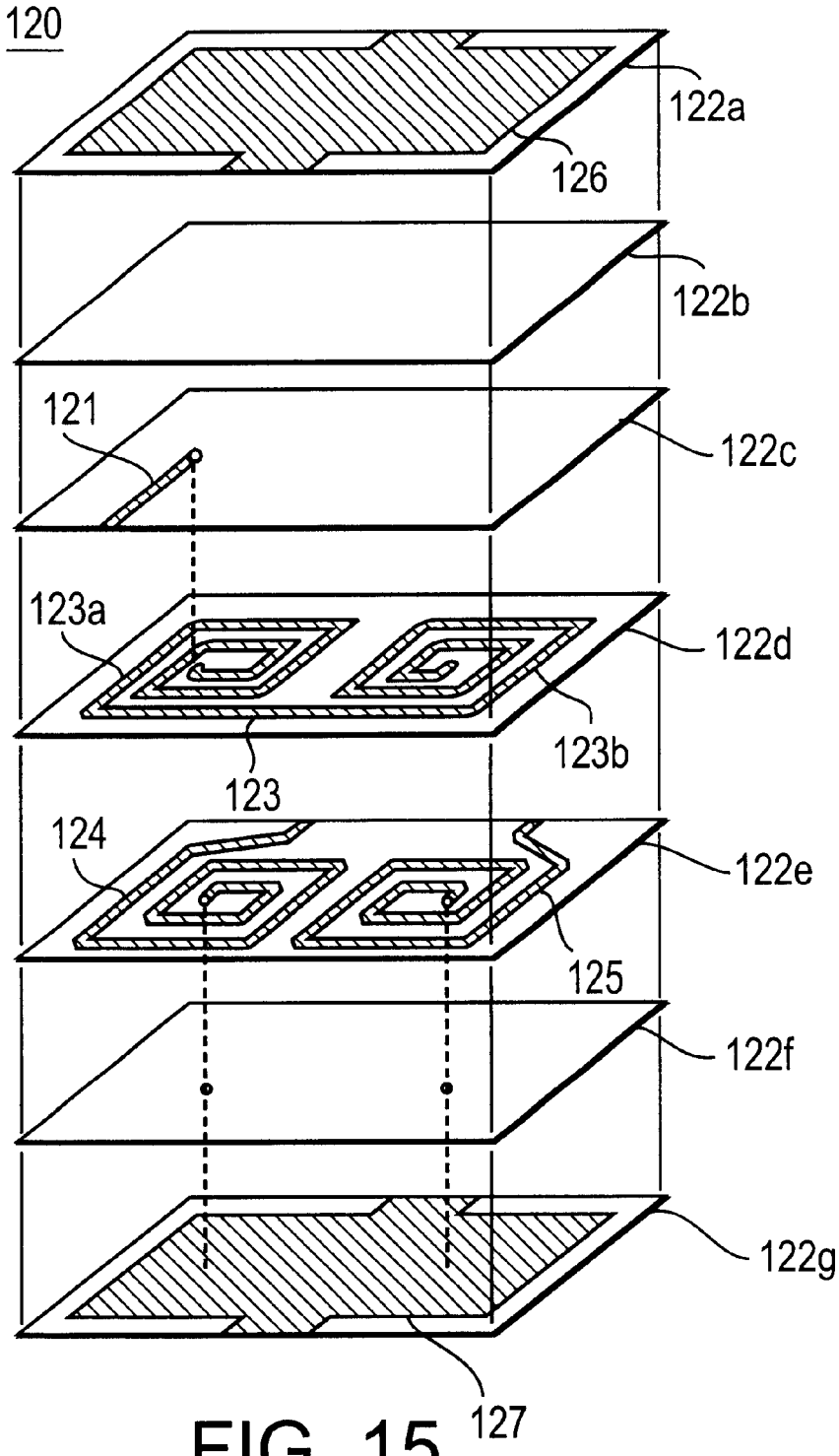
FIG. 15 PRIOR ART
FIG. 15 is an exploded perspective view of a high-frequency component using a conventional coupling line.

[Seventh and eighth embodiments; FIGS. 13 and 14]

Although, according to the balun 50 of the sixth embodiment, the first transmission line (unbalance line) 31 comprises the six line sections 31*a* to 31*f* and the second transmission line (balance line) 31 comprises the six line sections 32*a* to 32*f*, the first transmission line 31 and the second transmission line 32 can comprise six or more line sections in accordance with the necessary coupling quantities. According to a balun 50*a* of a seventh embodiment shown in FIG. 13 as an example, two line sections 31*ba* and 31*bb* are serially connected between the line sections 31*a* and 31*c* in the first transmission line 31 and two line sections 31*ea* and 31*eb* are serially connected between the line sections 31*d* and 31*f*. Two line sections 32*ba* and 32*bb* are serially connected between the line sections 32*a* and 32*c* in the second transmission line 32 and two line sections 32*ea* and 32*eb* are serially connected between the line sections 32*d* and 32*f*.

According to a balun 50*b* of an eighth embodiment shown in FIG. 14, three line sections 31*ba* to 31*bc* are serially connected between the line sections 31*a* and 31*c* in the first transmission line 31 and three line sections 31*ea* to 31*ec* are serially connected between the line sections 31*d* and 31*f*. Three line sections 32*ba* to 32*bc* are serially connected between the line sections 32*a* and 32*c* in the second transmission line 32 and three line sections 32*ea* to 32*ec* are serially connected between the line sections 32*d* and 32*f*. The line sections 31*a*, 31*bb*, and 31*c* are electro magnetically coupled to the line sections 32*c*, 32*bb*, and 32*a*, respectively. The line sections 31*d*, 31*eb*, and 31*f* are electro-magnetically coupled to the line sections 32*d,* 32*eb,* and 32*f,* respectively.

[Other embodiments]

The present invention is not limited to the embodiments and can be changed variously within a range of the essentials. For example, according to the first or second embodiment, it is able to omit either one of the shielding electrodes 23 which are formed on the dielectric sheets 12 and 19. The first and second transmission lines 31 and 32 neither need to be necessarily set to a ¼-wavelength of a predetermined frequency nor to have widths with same size throughout the all sections. The line sections 31*a* to 32*c* in the transmission lines 31 and 32 are not limited to the spiral or meandering pattern, and the pattern form or the combination of the patterns can be set in any desired manner.

Moreover, although according to the embodiments, the dielectric sheets onto which the conductors are formed are laminated and the dielectric sheets are thereafter baked integrally, the present invention is not limited thereto. A dielectric sheet which has already been baked may be used. A high-frequency component may be manufactured according to a manufacturing method as will be described hereinafter. That is, a sheet is coated with a paste dielectric-material by means such as means for printing, and the dielectric layer is formed. Thereafter, the surface of the dielectric layer is coated with a paste conductive-material, thereby forming any desired conductor. Next, the surface of the thus-formed conductor is coated with a paste dielectric material. The sequent overlappingly coating results in obtaining a high-frequency component having a laminating structure.

Obviously, as mentioned above, according to the present invention, it is possible to control the coupling quantity between the first transmission line and the second transmission line by changing the length and the number of electro-magnetic line sections which are electro-magnetically coupled, so that the electrical characteristic can be adjusted easily. When designing a coupling line whose electrical-magnetic coupling is coarse, it is able to obtain a high-frequency component using a small coupling line, without needing to increase the distance between the first transmission line and second transmission line.

A capacitor for impedance adjustment is connected to an input terminal or output terminal of the first transmission line or second transmission line, so that it is able to obtain a high-frequency component having a desired input/output impedance in accordance with an impedance of an external circuit.

What is claimed is:

1. A high-frequency component comprising:

a first transmission line and a second transmission line, and having at least one coupling portion for mutually coupling said first transmission line and said second transmission line electro-magnetically, wherein the coupling portion is located only at both end portions of the first transmission line and the second transmission line such that the first transmission line and the second transmission line are electro-magnetically coupled to each other only through the both end portions of the first transmission line and the second transmission line, and portions of the first and second transmission lines except for the end portions thereof are not electro-magnetically coupled to each other, such that a phase of a signal transmitted through the second transmission line is shifted by a desired amount of phase difference with respect to a phase of a signal transmitted through the first transmission line.

2. A high-frequency component according to claim 1, wherein said first transmission line functions as a main line and said second transmission line functions as a subline, thereby defining a coupler.

3. A high-frequency component according to claim 1, wherein a shielding electrode faces at least one of said first transmission line and said second transmission line.

4. A high-frequency component using a coupling line according to claim 2 or 3, wherein a capacitor for impedance adjustment is electrically connected to at least one of an input terminal and an output terminal in said main line.

5. A high-frequency component according to claim 2, wherein each of the main line and the subline has a double layer structure having a substantially ¼ wavelength of a desired central frequency.

6. A high-frequency component using a coupling line according to claim 1, wherein said first transmission line functions as an unbalance line and said second transmission line functions as a balance line and to thereby construct a balun, and said component has two coupling portions for mutually coupling said first transmission line and said second transmission line electro-magnetically, and a shielding electrode is arranged between the two coupling portions.

7. A high-frequency component using a coupling line according to claim 6, the shielding electrode faces each of said first transmission line and second transmission line.

8. A high-frequency component using a coupling line according to claim 6 or 7, a capacitor for impedance adjustment is electrically connected to an input terminal of one of said first transmission line and said second transmission line.

9. A high-frequency component according to claim 1, wherein the first and second transmission lines are defined by spiral line sections.

10. A high-frequency component according to claim 1, wherein each of the first transmission line and the second transmission line includes at least three line sections which are physically separate from each other and serially connected to each other, respectively.

11. A high-frequency component according to claim 10, wherein a first and a second of the at least three line sections of each of the first and second transmission lines are disposed at a common vertical level within the high-frequency component and define the end portions of the first and second transmission lines, respectively, which are electro-magnetically coupled to each other, and a third of the at least three line sections of each of the first and second transmission lines are located at a different vertical level than that of the first and second of the at least three lines sections, respectively.

12. A high-frequency component according to claim 11, wherein first ends of the first and second of the at least three line sections of the first transmission lines are located at a first side of the high-frequency component and first ends of the first and second of the at least three line sections of the second transmission lines are located at a second side of the high-frequency component that is opposite to the first side of the high-frequency component.

13. A high frequency component, comprising:

a first transmission line which has at least three conductive patterns and is constructed by serially connecting said conductive patterns electrically;

a second transmission line which has at least three conductive patterns and is constructed by serially connecting said conductive patterns electrically;

two shielding electrodes which are faced to said first transmission line and said second transmission line, respectively; and a laminate body including a plurality of laminated dielectric layers, in which said first transmission line and second transmission line are arranged, wherein the first transmission line and the second transmission line are electro-magnetically coupled to each other only through both ends of the first transmission line and the second transmission line, such that a phase of a signal transmitted through the second transmission line is shifted by a desired amount of phase difference with respect to a phase of a signal transmitted through the first transmission line.

14. A high-frequency component according to claim 13, wherein the conductive patterns of the first and second transmission lines include spiral line sections.

15. A high-frequency component according to claim 13, wherein a first and a second of the at least three conductive patterns of each of the first and second transmission lines are located on a common one of the dielectric layers, respectively, and a third of the at least three conductive patterns of each of the first and second transmissions lines is located on a different one of the dielectric layers, respectively.

16. A high-frequency component according to claim 15, wherein the common one of the dielectric layers including the first and second of the at least three conductive patterns of the first transmission line is located adjacent to the common one of the dielectric layers including the first and second of the at least three conductive patterns of the second transmission line.

17. A high-frequency component according to claim 15, wherein said first and second of the at least three conductive patterns of each of the first and second transmission lines define the end portions of the first and second transmission lines which are electro-magnetically coupled together.

18. A high-frequency component according to claim 13, wherein a first and a second of the at least three conductive patterns of each of the first and second transmission lines have first ends extending to a common side of the laminate body such that the first ends are located at the common side but are spaced from each other along the common side, and have second ends which are located in an inner portion of the laminate body, and a third of the at least three conductive patterns have first and second ends which are located in the inner portion of the laminate body.

19. A high-frequency component according to claim 18, wherein the first ends of the first and second of the at least three conductive patterns of the first transmission lines are located at a first side of the laminated body and the first ends of the first and second of the at least three conductive patterns of the second transmission lines are located at a second side of the laminate body that is opposite to the first side of the laminate body.

* * * * *